US008246368B2

(12) United States Patent
Buethe et al.

(10) Patent No.: US 8,246,368 B2
(45) Date of Patent: Aug. 21, 2012

(54) ELECTRICAL CONNECTOR WITH A HOUSING MOVABLE RELATIVE TO A CARRIER AND A LEVER LATCHING ON THE HOUSING WITH A LATCHING SOUND

(75) Inventors: Rainer Buethe, Meinerzhagen (DE); Hartmut Soennecken, Meinerzhagen (DE); Wilfried Heringhaus, Herne (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 13/371,517

(22) Filed: Feb. 13, 2012

(65) Prior Publication Data

US 2012/0142205 A1 Jun. 7, 2012

Related U.S. Application Data

(63) Continuation of application No. PCT/EP2010/069129, filed on Dec. 8, 2010.

(30) Foreign Application Priority Data

Dec. 9, 2009 (DE) ..... 10 2009 057 688

(51) Int. Cl.
*H01R 13/15* (2006.01)

(52) U.S. Cl. ..... 439/259

(58) Field of Classification Search ..... 439/259, 439/258, 342, 263–265, 352
See application file for complete search history.

(56) References Cited

U.S. PATENT DOCUMENTS

| | | | | |
|---|---|---|---|---|
| 4,678,256 | A * | 7/1987 | Nishino et al. | 439/347 |
| 4,726,783 | A * | 2/1988 | Nakazawa et al. | 439/350 |
| 5,702,266 | A * | 12/1997 | Jones | 439/357 |
| 6,056,570 | A * | 5/2000 | Maejima | 439/259 |
| 7,033,201 | B2 * | 4/2006 | Ichida et al. | 439/352 |

(Continued)

FOREIGN PATENT DOCUMENTS

DE 10326834 A1 12/2004

(Continued)

OTHER PUBLICATIONS

International Bureau Patent Cooperation Treaty, International Preliminary Report on Patentability for corresponding International Application No. PCT/EP2010/069129 issued Jun. 12, 2012.

*Primary Examiner* — Chandrika Prasad
(74) *Attorney, Agent, or Firm* — Brooks Kushman P.C.

(57) ABSTRACT

An electrical plug-type connector includes a carrier, a sleeve contact having a movable tensioning sleeve, a housing movable relative to the carrier, a mating component having a pin configured to make contact with the sleeve contact, and a lever having first and second lever arms. Joining of the mating component with the carrier causes an anti-displacement element between the housing and the carrier to be released and, as a result of a displacement of the housing relative to the carrier, the tensioning sleeve moves and presses the sleeve contact against the pin and the first lever arm displaces and connects with the mating component and the displacement of the first lever arm builds spring tension that is applied in the second lever arm such that the second lever arm latches on the housing with a latching sound when the housing reaches an end position relative to the carrier.

20 Claims, 4 Drawing Sheets

U.S. PATENT DOCUMENTS

| | | | | |
|---|---|---|---|---|
| 7,101,213 | B2 * | 9/2006 | Toyoda | 439/358 |
| 7,232,323 | B2 * | 6/2007 | Mohs et al. | 439/265 |
| 7,275,951 | B2 | 10/2007 | Shigeta et al. | |
| 2007/0049088 | A1 * | 3/2007 | Mohs et al. | 439/265 |

FOREIGN PATENT DOCUMENTS

| | | | |
|---|---|---|---|
| DE | 10348576 | A1 | 5/2005 |
| DE | 102005040952 | A1 | 3/2007 |
| EP | 1143569 | A2 | 10/2001 |

* cited by examiner

ELECTRICAL CONNECTOR WITH A HOUSING MOVABLE RELATIVE TO A CARRIER AND A LEVER LATCHING ON THE HOUSING WITH A LATCHING SOUND

CROSS-REFERENCE TO RELATED APPLICATIONS

This application is a continuation of International Application No. PCT/EP2010/069129, published in German, with an International filing date of Dec. 8, 2010, which claims priority to DE 10 2009 057 688.6, filed Dec. 9, 2009, the disclosures of which are incorporated by reference.

TECHNICAL FIELD

The present invention relates to an electrical zero-force plug-type connector having a contact carrier and sleeve contacts in which the contact carrier has sleeve contact receptacles and each sleeve contact has a base body that forms contact laminations and has a tensioning sleeve that is movable on the base body; a mating connector that has contact pins configured to make contact with the sleeve contacts; and a housing that can be moved in different positions relative to the contact carrier; in which the mating connector when joined with the contact carrier releases an anti-shift element between the contact carrier and the housing and, as a result of the housing being moved against the contact carrier, the tensioning sleeves move along the respective base bodies of the sleeve contacts and press the contact laminations against the contact pins of the mating connector; and in which the contact carrier holds a two-armed lever and the movement of the housing with respect to the contact carrier connects a first lever arm of the lever to the mating connector.

BACKGROUND

DE 10 2005 040 952 A1 (corresponds to U.S. Pat. No. 7,232,323) describes such an electrical zero-force plug-type connector. The connector includes two housing parts in the form of a protective housing and a locking housing. The housings can insert into one another in first and second latching positions. The sleeve contacts hold open the tensioning sleeves, which are connected with the protective housing, when the housings are in the first latching position. As a result, the contact pins of a mating connector (i.e., an equipment connector) can be connected with little force to the sleeve contacts. Insertion of the mating connector releases the lock of the latching connection between the housings and brings the housings together into the second latching position. In the second latching position, the tensioning sleeves press the contact laminations of the sleeve contacts against the contact pins of the mating connector.

This latching mechanism enables the contact pins to be inserted freely. The contact force between the contact laminations of the sleeve contacts and the contact pins is produced in the final joining phase of the connector components. In order that mechanical stresses are not transmitted to the contact pins, a spring-loaded snap-fit rocker is integrally molded onto the outer wall of the protective housing. While joining to the mating connector, a spring arm of the rocker latches to a lug on the mating connector and form-fittingly connects both connector components to one another. The opening of this latching connection to separate the connector components can be achieved by exerting pressure on the free spring arm of the rocker.

Two acoustic or haptically detectable latching sounds occur sequentially over a short time interval during proper insertion while the connector components are joined to the mating connector. The two latching sounds respectively result from the latching of the protective and locking housings and the latching of the rocker of the protective housing on the mating connector.

As only one latching sound is produced with conventional connector components, a person making the connection might incorrectly conclude that the connector is assembled correctly upon hearing the single latching sound. If no mechanical stop exists in a form fitting manner between the connector components, then this can lead to faulty operation of the connection and to dangerous conditions in safety critical applications due to mechanical effects on the connection.

SUMMARY

An object of the present invention is an electrical zero-force plug-type connector devoid of the defects described above.

In carrying out at least one of the above and other objects, an electrical plug-type connector is provided. The connector includes a carrier, a sleeve contact, a housing, a mating component, and a lever. The carrier has a receptacle. The sleeve contact has a body with a contact lamination and a tensioning sleeve movable relative to the body. The housing is movable relative to the carrier. The mating component has a pin configured to make contact with the sleeve contact when the mating component and the carrier are joined and the sleeve contact is received in the receptacle. The lever is held by the carrier. The lever has first and second lever arms. The housing and the carrier form an anti-displacement element therebetween which prevents movement of the housing relative to the carrier. Joining of the mating component with the carrier causes the anti-displacement element to be released and, as a result of a displacement of the housing relative to the carrier, the tensioning sleeve moves along the body and presses the contact lamination against the pin and the first lever arm displaces and connects with the mating component and the displacement of the first lever arm builds spring tension that is applied in the second lever arm, which bears against the housing, such that the second lever arm latches on the housing with a latching sound when the housing reaches an end position relative to the carrier.

Further, in carrying out at least one of the above and other objects, another electrical plug-type connector is provided. The connector includes a carrier, a sleeve contact having a movable tensioning device, a housing movable relative to the carrier, a mating component having a pin configured to make contact with the sleeve contact, and a lever having first and second lever arms. Joining of the mating component with the carrier causes an anti-displacement element between the housing and the carrier to be released and, as a result of a displacement of the housing relative to the carrier, the tensioning sleeve moves and presses the sleeve contact against the pin and the first lever arm displaces and connects with the mating component and the displacement of the first lever arm builds spring tension that is applied in the second lever arm such that the second lever arm latches on the housing with a latching sound when the housing reaches an end position relative to the carrier.

Embodiments of the present invention are directed to an electrical plug-type connector having a contact carrier and sleeve contacts, a mating (equipment) connector, and a housing part. The contact carrier has sleeve contact receptacles. Each sleeve contact has a base body that forms contact laminations. Each sleeve contact further has a tensioning sleeve that is movably connected with respect to the base body. The mating connector has contact pins configured to make contact with the sleeve contacts when the mating connector is joined to the contact carrier and the sleeve contacts are received in the sleeve contact receptacles of the contact carrier. The housing can be positioned in different positions on the contact carrier. The joining of the mating connector with the contact carrier causes an anti-shift element between the contact carrier and the housing to be released. Concurrently, as a result of the housing being moved with respect to the contact carrier, the tensioning sleeves move along the respective base bodies of the sleeve contacts and press the contact laminations against the contact pins of the mating connector. The contact carrier holds a two-armed lever. The movement or displacement of the housing with respect to the contact carrier form-fittingly connects a first lever arm of the lever to the mating connector.

The movement or displacement of the housing with respect to the contact carrier initially shifts or displaces the first lever arm. As a result, a spring stress builds up in the second lever arm, which bears against the housing. The second lever arm latches in on or behind the housing with a latching noise when the housing reaches an end position.

As described, the electrical connector in accordance with embodiments of the present invention is characterized in that during the insertion process the application of the normal contact force and the latching of the connector components to one another are sequential, wherein an acoustic or haptically detectable feedback occurs after the end of the second process as a signal of the orderly completion of the full assembly of the electrical connector.

The above features, and other features and advantages of the present invention are readily apparent from the following detailed description thereof when taken in connection with the accompanying drawings. It is understood that the features stated above and to be explained below may be used not only in the particular stated combination, but also in other combinations or alone without departing from the scope of the present invention.

Exemplary embodiments of the present invention are illustrated in the drawings and explained in greater detail in the following description. Identical, similar, or functionally equivalent components are denoted by the same reference numerals.

DETAILED DESCRIPTION

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
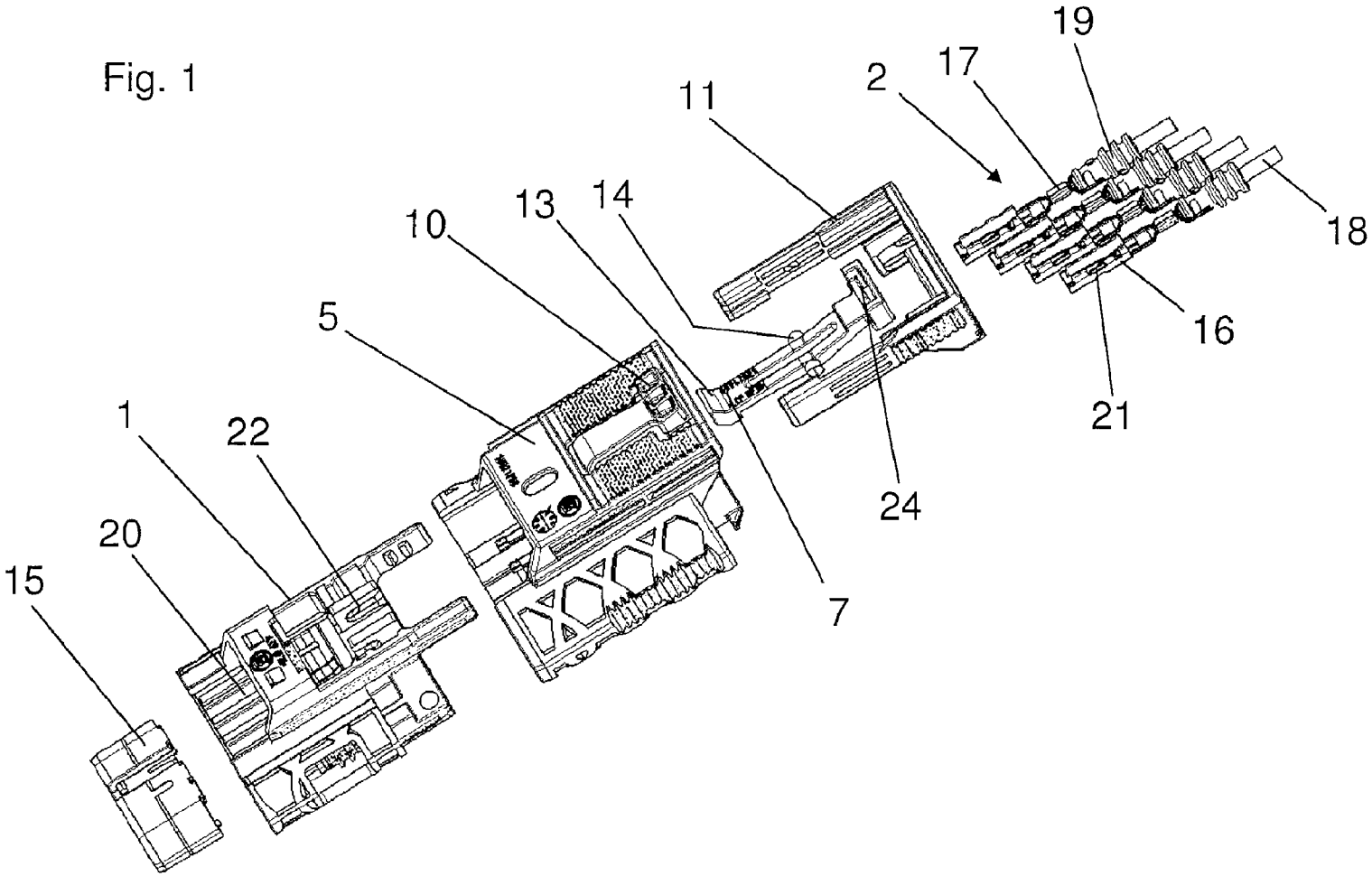
FIG. 1 illustrates an exploded view of the individual parts of a connector component of an electrical zero-force plug-type connector in accordance with an embodiment of the present invention.

Referring now to FIG. 1, an exploded view of the individual parts of a connector component of an electrical zero-force plug-type connector in accordance with an embodiment of the present invention is shown. The connector component includes a contact carrier 1, a plurality of sleeve contacts 2, and a housing part 5. In addition to the connector component, the electrical connector further includes an mating connector part 3 (i.e., a mating connector) (shown in FIGS. 2 through 5).

Contact carrier 1 includes a plurality of sleeve contact receptacle chambers 20. Receptacle chambers 20 are configured to receive respective sleeve contacts 2 inserted therein. A cover 15 is attachable to the end of contact carrier 1. When sleeve contacts 2 are mounted within receptacle chambers 20, the front sections of sleeve contacts 2 extend up to cover 15 attached to the end of contact carrier 1.

Each sleeve contact 2 has a base body 16 that forms contact laminations 40. Base body 16 is connected to an electrical connector line 18 through a crimped connection 17. Connector line 18 is surrounded by a rubber seal 19. Seal 19 seals receptacle chamber 20 of contact carrier 1 against the penetration of moisture after insertion of sleeve contact 2 into receptacle chamber 20.

Each sleeve contact 2 further has a tensioning sleeve 21. Tensioning sleeve 21 is movably connected with respect to base body 16 (e.g., tensioning sleeve 21 is displaceably arranged on base body 16). Tensioning sleeve 21 is moved along base body 16 to press the contact laminations formed by base body 16 toward one another in a displaced position.

Mating connector 3 (shown in FIGS. 2 through 5) has contact pins 4. Mating connector 3 is joinable to contact carrier 1. Contact pins 4 are configured to make contact with respective sleeve contacts 2 when mating connector 3 and contact carrier 1 are joined together while sleeve contacts 2 are received in receptacle chambers 20 of contact carrier 1. In particular, contact pin 4 inserts into base body 16 of sleeve contact 2 with the contact laminations being pressed against contact pin 4 in the displaced position, whereby a secure electrical contact is produced. On the other hand, when tensioning sleeve 21 is located opposite to the displaced position, no contact force acts on contact pin 4 so that contact pin 4 can be inserted into or removed from base body 16 of sleeve contact 2 with minimal force. Additional details regarding the design and functionality of such sleeve contacts and contact pins can be found in U.S. Pat. No. 7,232,323.

Housing 5 has the form of a sleeve that surrounds contact carrier 1. Housing 5 can be displaced on contact carrier 1 in the direction of its longitudinal axis. For example, housing 5 can be positioned in different positions on contact carrier 1. For a mounted connector component, tensioning sleeves 21 of sleeve contacts 2 are connected to housing 5 and are movable along and actuated by a displacement of housing 5 against contact carrier 1.

The connector component of the electrical connector further includes a lever 7. Lever 7 is pivotably arranged on a bearing position 22 inside contact carrier 1. Lever 7 is formed from plastic strips. Lever 7 includes an integrally molded latching hook 13 on one end section and an integrally molded latch 24 on the opposite end section. Lever 7 has an integrally molded stub shaft 14 in a middle section running perpendicular to its longitudinal axis. Stub shaft 14 can be inserted into a receptacle at bearing position 22 on contact carrier 1. Lever 7 forms a two-arm lever in the physical sense. Two-arm lever 7 includes a first lever arm 8 and a second lever arm 9.

The connector component of the electrical connector further includes a lock 11. Lock 11 can be displaced against housing 5 to enable a stop for lever 7 in at least one lever position of the correctly latched housing.

Referring now to FIGS. 2 through 5, with continual reference to FIG. 1, respective cross-sectional views of different assembly phases of the connector component and mating connector 3 being joined to assemble the electrical connector are shown. In particular, mating connector 3 joins with contact carrier 1 upon insertion of the connector component on mating connector 3.

Figure 2:
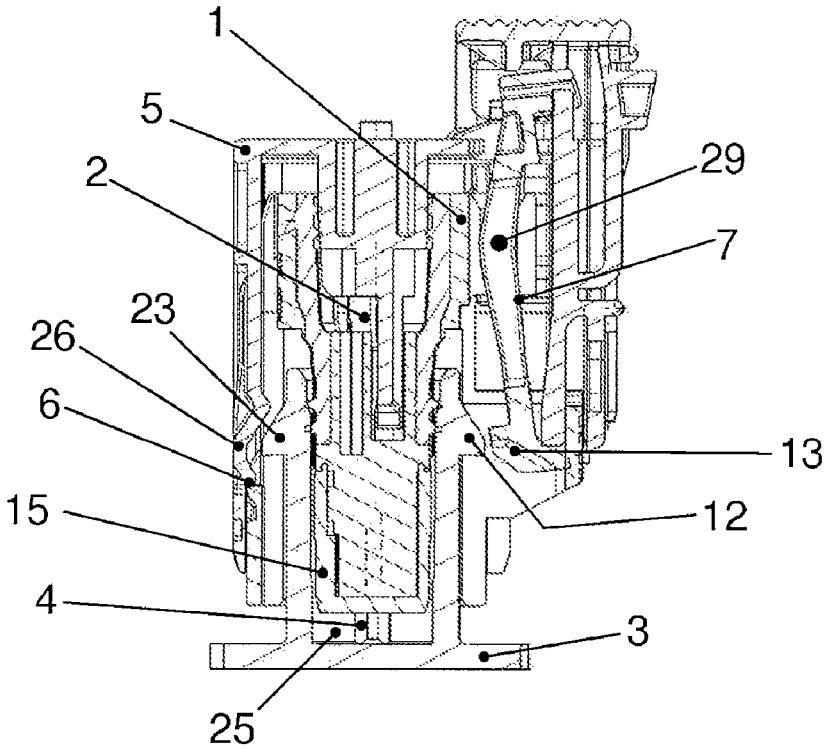
FIGS. 2 through 5 illustrate respective cross-sectional views of different assembly phases of the connector component and a mating connector part being joined to assemble the electrical zero-force plug-type connector.

FIG. 2 illustrates the beginning of the insertion process in which contact pins 4 of mating connector 3 are initially partially inserted into sleeve contacts 2. In this assembly phase, an intermediate space 25 is between the underside of cover 15 and the base plate of mating connector 3. From the presence of intermediate space 25 it can be understood that the connector components are not yet completely connected together.

Figures 6A, 6B:
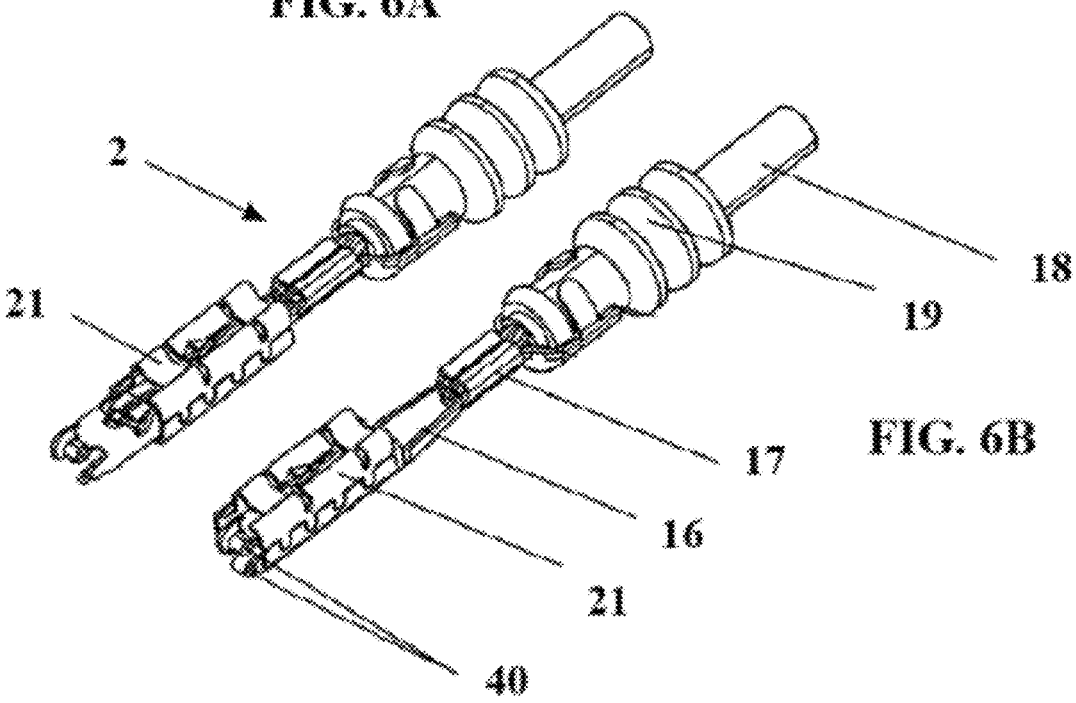
FIG. 6A illustrates a sleeve contact in which the tensioning sleeve is positioned along the base body away from the contact laminations such that the contact laminations are in an opened position to receive a contact pin inserted therein.
FIG. 6B illustrates a sleeve contact in which the tensioning sleeve is positioned along the base body over the contact laminations such that the contact laminations are in a closed position whereby an electrical contact is secured with a contact pin inserted therein.

The insertion of contact pins 4 of mating connector 3 into sleeve contacts 2 occurs with minimal applied force as housing 5, connected with tensioning sleeves 21, is located in a position with respect to contact carrier 1 in which tensioning sleeves 21 hold sleeve contacts 2 open for contact pins 4 to be inserted therein. (FIG. 6A illustrates this tensioning sleeve placement.) This positioning is established by an anti-displacement or anti-shift element 6 between contact carrier 1 and housing 5. Anti-shift element 6 prevents displacement of housing 5 against contact carrier 1 in this assembly phase.

The position of the axis of rotation 29 of lever 7 is indicated at a point corresponding to a section by an imaginary longitudinal axis through stub shaft 14 of lever 7. Latching hook 13 of lever 7 is located in this assembly phase at approximately the height of a first projection 12 of mating connector 3. First projection 12 is integrally molded on mating connector 3. Lying opposite projection 12, mating connector 3 has an integrally molded second projection 23. In this assembly phase, second projection 23 projects into a notch of an angled wall section 26 of housing 5. Angled wall section 26 with second projection 23 projected therein forms part of anti-displacement or anti-shift element 6.

Figure 3:
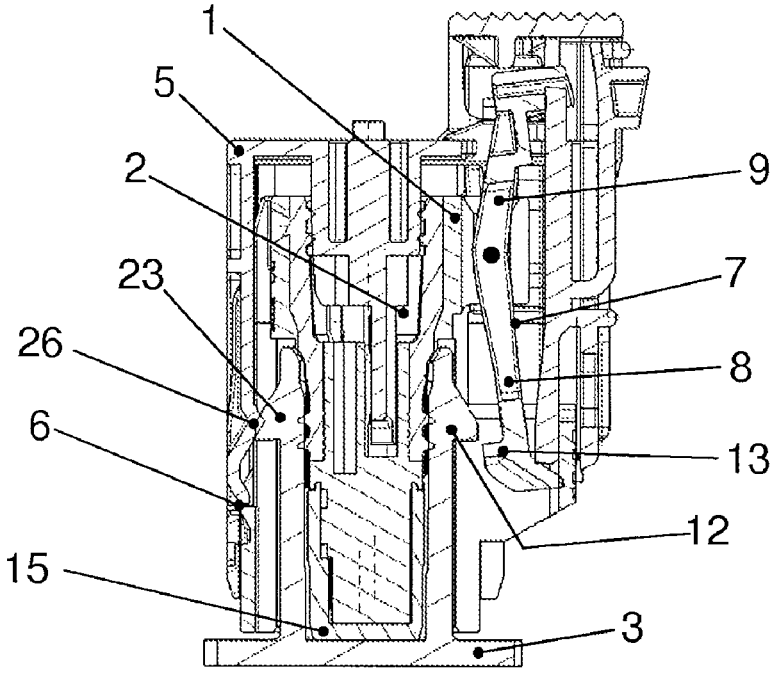

In the next assembly phase, shown in FIG. 3, the underside of cover 15 meets the base plate of mating connector 3 and the insertion of contact pins 4 of mating connector 3 into sleeve contacts 2 is complete. Latching hook 13 of lever 7 now lies below first projection 12 of mating connector 3. However, latching hook 13 and first projection 12 do not yet latch since no actuating force acts on lever arms 8, 9 of lever 7 to displace lever 7 and lever 7 is not spring loaded. Angled wall section 26 of housing 5 concurrently strikes second projection 23 of mating connector 3 whereby anti-displacement element 6, i.e., the form fitting connection between contact carrier 1 and housing 5, is disengaged. That is, mating connector 3 when joined with contact carrier 1 releases anti-displacement element 6. In this manner, housing 5 can now be displaced with respect to contact carrier 1.

Tensioning sleeves 21 are connected to housing 5 against base bodies 16 which are connected to contact carrier 1. During the displacement of housing 5 against contact carrier 1, tensioning sleeves 21 are displaced such that a contact force from sleeve contacts 2 acts on contact pins 4 and thus produces a complete electrical connection. That is, as a result of housing 5 being moved with respect to contact carrier 1, tensioning sleeves 21 concurrently move along the respective base bodies 16 and press the contact laminations against contact pins 4 of mating connector 3. (FIG. 6B illustrates this tensioning sleeve placement.)

Figure 4:
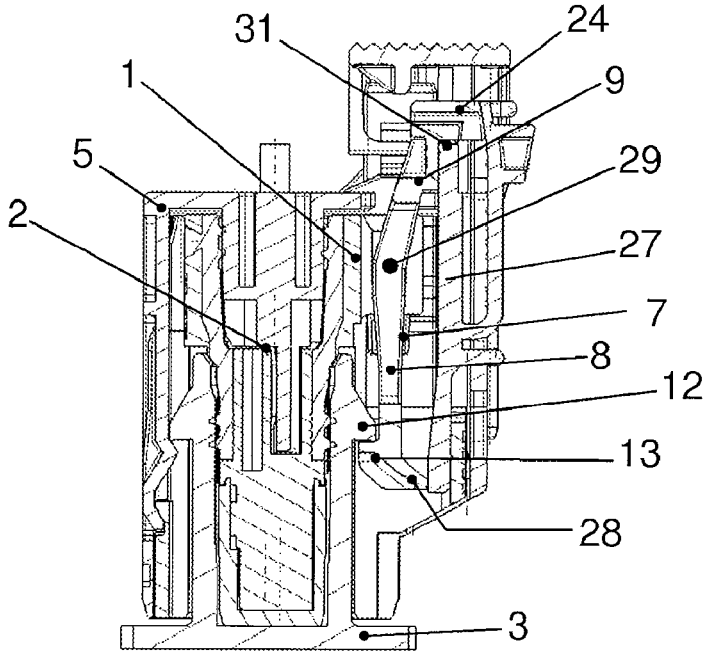

With reference to FIG. 4, housing 5 includes a tongue-shaped section 27. Tongue-shaped section 27 is displaced toward mating connector 3 during the displacement of housing 5 against contact carrier 1. In this assembly phase, tongue-shaped section 27 thereby strikes rear part 28 of latching hook 13. This presses the front part of latching hook 13 under first projection 12 and thereby brings lever 7 into a form fitting connection with mating connector 3. That is, the movement or displacement of housing 5 with respect to contact carrier 1 form-fittingly connects first lever arm 8 to mating connector 3. In this position, latching hook 13 is surrounded on both sides and blocked by mating connector 3 and tongue-shaped section 27.

Due to the lateral displacement of latching hook 13 by tongue-shaped section 27 of housing 5, first lever arm 8 is rotated about rotational axis 29 of lever 7. The displacement of second lever arm 9 is blocked by the upper part of tongue-shaped section 27 so that a spring force builds up in lever 7. During further downward vertical motion of tongue-shaped section 27, second lever arm 9 is finally released and form-fittingly latches, due to the spring force, with an integrally molded latch 24 behind an edge 31 of tongue-shaped section 27, and thereby stops housing 5. This produces a clearly audible acoustic latching sound and a haptically detectable vibration of housing 5. That is, the movement of housing 5 initially shifts or displaces first lever arm 8 and, as a result, a spring stress builds up in second lever arm 9, which bears against housing 5. Second lever arm 9 latches in on or behind housing 5 with a latching noise when housing 5 reaches an end position.

Figure 5:
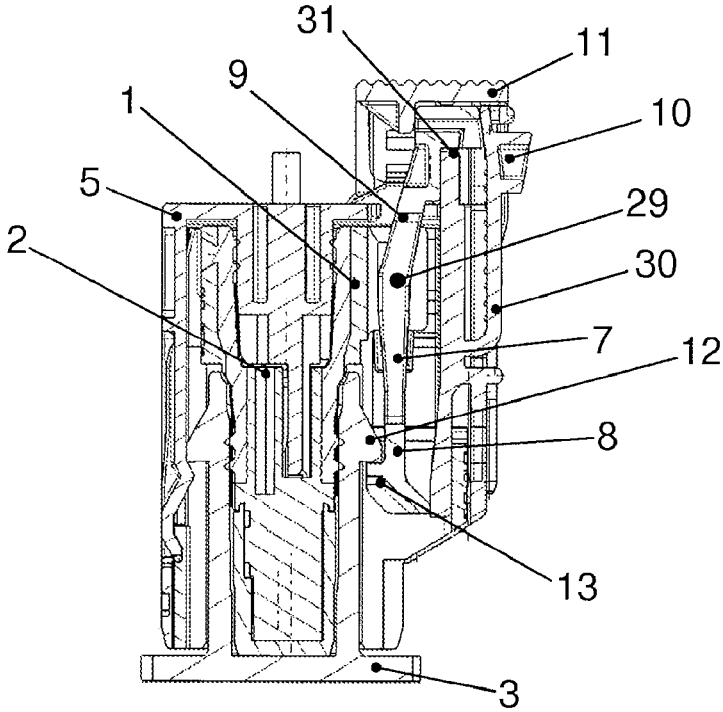

Second lever arm 9 can be secured in the position that has been attained by lock 11 which can be displaced against housing 5. The connector components that are completely coupled to one another in this manner are shown in FIG. 5.

The only joining process that occurs during the assembly of the electrical connector under spring pressure, and are thus acoustically and haptically detectable, occur only after the conclusion of all relevant assembly processes (up to the closure of lock 11, whose position can be monitored visually) and presumes that the previous assembly steps have been carried out correctly. A displacement of housing 5 against contact carrier 1 is required in order to produce a spring tension in lever arms 8, 9, which can only occur when anti-displacement element 6 is released. This in turn pre-supposes that contact carrier 1 has attained its final position on mating connector 3, whereby the correct electrical contact is assured between sleeve contacts 2 and contact pins 4. The occurrence of the single latching sound can thus be used as the confirmation signal for a correct and completely assembled connector component.

Thus, the electrical connector is characterized in that during the insertion process the application of the normal contact force and the latching of the connector components to one another are sequential, wherein an acoustic or haptically detectable feedback occurs after the end of the second process as a signal of the orderly assembly completion of the electrical connector.

The form fit connection between mating connector 3 and contact carrier 1 produced by lever 7 is self-locking. Latching hook 13 on first lever arm 8 is pressed on mating connector 3 under first projection 12 of mating connector 3 by tongue-shaped section 27. This connection cannot be easily released by displacing housing 5 as displacement of tongue-shaped section 27 is blocked by second lever arm 9.

In order to separate the connector components if necessary without having to use a tool, an actuating strap 10 through which a separation of the connected connector components can be initiated in a particularly simple manner is provided. Actuating strap 10 is a bar that moves parallel to tongue-shaped section 27. Actuating strap 10 is molded with one end section on tongue-shaped section 27 and forms an actuating knob 30 with the other end section. Actuating knob 30 is formed and arranged such that it lies on the section of lever 7 that is latched to the rear of tongue-shaped section 27. When an actuating pressure is exerted on actuating knob 30, its rear surface pushes the latched second lever arm 9 away from edge 31 of tongue-shaped section 27, causing the stop of tongue-shaped section 27 to release. Latching hook 13 is concurrently unloaded by pivoting of tongue-shaped section 27. Due to the force acting on second lever arm 9, a rotational motion is transmitted to first lever arm 8 through rotational axis 29, by which latching hook 13 is moved out of the way of first projection 12 of mating connector 3. The form fit connection between latching hook 13 and mating connector 3 is thus also released. Housing 5 can now be displaced against contact carrier 1, wherein only the force needed to release the contact forces on tensioning sleeves 21 may be now applied.

LIST OF REFERENCE NUMBERS

1 contact carrier
2 sleeve contact
3 mating (equipment) connector (mating component)
4 contact pins
5 housing part
6 anti-displacement (anti-shift) element
7 lever
8 first lever arm
9 second lever arm
10 actuating strap
11 lock
12 (first) projection
13 latching hook
14 stub shaft
15 cover
16 base body
17 crimped connection
18 connector line
19 rubber seal
20 receptacle chamber
21 tensioning sleeve
22 bearing position
23 (second) projection
24 latch
25 intermediate space
26 angled wall section
27 tongue-shaped section
28 rear part (of the latching hook)
29 axis of rotation
30 actuating knob
31 edge
40 contact laminations While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electrical plug-type connector comprising:
a carrier having a receptacle;
a sleeve contact having a body with a contact lamination and a tensioning sleeve movable relative to the body;
a housing movable relative to the carrier;
a mating component having a pin configured to make contact with the sleeve contact when the mating component and the carrier are joined and the sleeve contact is received in the receptacle;
a lever held by the carrier, the lever having first and second lever arms;
wherein the housing and the carrier form an anti-displacement element therebetween which prevents movement of the housing relative to the carrier;
wherein joining of the mating component with the carrier causes the anti- displacement element to be released and, as a result of a displacement of the housing relative to the carrier, the tensioning sleeve moves along the body and presses the contact lamination against the pin and the first lever arm displaces and connects with the mating component and the displacement of the first lever arm builds spring tension that is applied in the second lever arm, which bears against the housing, such that the second lever arm latches on the housing with a latching sound when the housing reaches an end position relative to the carrier.

2. The connector of claim 1 wherein:
the second lever arm stops the housing when the housing reaches the end position relative to the carrier.

3. The connector of claim 1 wherein:
the connection between the first lever arm and the mating component is a form-fit connection.

4. The connector of claim 3 wherein:
the mating component includes a projection and the first lever arm includes a latching hook, wherein the form-fit connection between the first lever arm and the mating component is produced by the latching hook latching onto the projection.

5. The connector of claim 1 wherein:
the second lever arm can be stopped by a displaceable lock.

6. The connector of claim 1 wherein:
the housing has an actuating strap configured to transmit an actuating pressure to the second lever arm to unlatch the second lever arm from the housing and concurrently release the connection between the first lever arm and the mating connector.

7. The connector of claim 1 wherein:
the mating component includes first and second projections;
the first lever arm includes a latching hook;
wherein the connection between the first lever arm and the mating component is produced by the latching hook latching onto the first projection.

8. The connector of claim 7 wherein:
the housing includes an angled-wall section having a notch;
wherein the second projection of the mating component projected into the notch of the angled-wall section of the housing forms the anti-displacement element.

9. The connector of claim 8 wherein:

the housing further includes a tongue-shaped section;

wherein the tongue-shaped section blocks displacement of the second lever arm to build the spring tension that is applied to the second lever arm.

10. An electrical plug-type connector comprising:

a carrier;

a sleeve contact having a movable tensioning sleeve;

a housing movable relative to the carrier;

a mating component having a pin configured to make contact with the sleeve contact;

a lever having first and second lever arms;

wherein joining of the mating component with the carrier causes an anti-displacement element between the housing and the carrier to be released and, as a result of a displacement of the housing relative to the carrier, the tensioning sleeve moves and presses the sleeve contact against the pin and the first lever arm displaces and connects with the mating component and the displacement of the first lever arm builds spring tension that is applied in the second lever arm such that the second lever arm latches on the housing with a latching sound when the housing reaches an end position relative to the carrier.

11. The connector of claim 10 wherein:

the second lever arm stops the housing when the housing reaches the end position relative to the carrier.

12. The connector of claim 10 wherein:

the connection between the first lever arm and the mating component is a form-fit connection.

13. The connector of claim 12 wherein:

the mating component includes a projection and the first lever arm includes a latching hook, wherein the form-fit connection between the first lever arm and the mating component is produced by the latching hook latching onto the projection.

14. The connector of claim 10 wherein:

the second lever arm can be stopped by a displaceable lock.

15. The connector of claim 10 wherein:

the housing has an actuating strap configured to transmit an actuating pressure to the second lever arm to unlatch the second lever arm from the housing and concurrently release the connection between the first lever arm and the mating connector.

16. The connector of claim 10 wherein:

the mating component includes first and second projections;

the first lever arm includes a latching hook;

wherein the connection between the first lever arm and the mating component is produced by the latching hook latching onto the first projection.

17. The connector of claim 16 wherein:

the housing includes an angled-wall section having a notch;

wherein the second projection of the mating component projected into the notch of the angled-wall section of the housing forms the anti-displacement element.

18. The connector of claim 17 wherein:

the housing further includes a tongue-shaped section;

wherein the tongue-shaped section blocks displacement of the second lever arm to build the spring tension that is applied to the second lever arm.

19. The connector of claim 10 wherein:

the lever is held by the carrier.

20. The connector of claim 10 wherein:

the sleeve contact has a contact lamination which is pressed against the pin when the tensioning sleeve moves and presses the sleeve contact against the pin.

* * * * *